United States Patent [19]

Skrocki

[11] Patent Number: 4,598,643

[45] Date of Patent: Jul. 8, 1986

[54] EXPLOSIVE CHARGE LINER MADE OF A SINGLE CRYSTAL

[75] Inventor: Roger R. Skrocki, Concord Township, Lake County, Ohio

[73] Assignee: TRW Inc., Cleveland, Ohio

[21] Appl. No.: 682,786

[22] Filed: Dec. 18, 1984

[51] Int. Cl.[4] ..... F42B 1/00

[52] U.S. Cl. ..... 102/307; 102/476

[58] Field of Search ..... 102/475, 476, 306, 307, 102/308, 309, 310

[56] References Cited

U.S. PATENT DOCUMENTS

| | | | |
|---|---|---|---|
| 2,595,960 | 10/1948 | Lawrence | 102/306 |
| 2,851,918 | 1/1954 | MacLeod | 102/306 |
| 3,079,861 | 5/1959 | Charrin | 102/331 |
| 3,112,700 | 12/1959 | Gehring, Jr. | 102/306 |
| 3,128,701 | 7/1958 | Rinehart et al. | 102/306 |
| 3,771,586 | 11/1973 | Waring | 164/279 |
| 4,109,576 | 8/1978 | Eckels | 102/307 |

*Primary Examiner*—Deborah L. Kyle
*Assistant Examiner*—Michael J. Carone
*Attorney, Agent, or Firm*—Calvin G. Covell; Sol L. Goldstein

[57] ABSTRACT

An improved liner for a shaped explosive charge has a metal side wall with an outer side surface which is adapted to be engaged by the explosive charge and an inner side surface which defines an outwardly flaring cavity. The side wall is formed of a single crystal of metal and is free of grain boundaries. The single crystal of metal is composed of atoms arranged as unit cells all having the same orientation relative to the central axis of the cavity. This tends to optimize the performance of the shaped charge and allows the designer of the shaped charged freedom to completely specify the crystallographic orientation of the side wall of the liner.

7 Claims, 5 Drawing Figures

EXPLOSIVE CHARGE LINER MADE OF A SINGLE CRYSTAL

BACKGROUND OF THE INVENTION

The present invention relates to a liner which is used with an explosive charge.

Shaped explosive charges which use metal liners are commonly made in a wide variety of designs, sizes and functions and are commonly used in military warheads, underwater projects, oil drilling operations, mining, demolition, and construction projects. The shaped charge liners are currently manufactured by conventional metal forming and machining processes. These manufacturing processes result in the liner having a polycrystalline microstructure.

The polycrystalline microstructure of known liners can have a wide range of grain sizes and morphologies. The mechanical properties of these components are primarily isotropic (non-directional). However, it has been recognized that the performance of an explosive device can be significantly affected by differences in grain size and morphology. In particular, it has been found that certain crystallographic textures, which result from prior forming processes, tend to enhance performance. It has also been found that grain size and uniformity can significantly affect performance.

Because of the polycrystalline nature of traditional metals and alloys, the designer of liners for use with explosive charges, whether of the self-forging fragment type or jet type, has been limited in his ability to control the crystal microstructure of the liner. With a polycrystalline microstructure, grain boundaries are present and crystallographic orientation within the plurality of grains cannot be controlled to a high degree. Some degree of control over grain size, grain morphology and crystallographic texture has been obtained by carefully controlled processing, but these efforts have been limited by the basic nature of the polycrystalline material. Similarly, because of the polycrystalline nature of conventional shaped charge liners, uniformity of structure from batch-to-batch and part-to-part cannot always be controlled to the extent desired to assure repeatable explosive deformation and jet formation.

SUMMARY OF THE PRESENT INVENTION

The present invention provides a new and improved liner for use with an explosive charge. The liner has a side wall with an outer side surface which is engaged by an explosive charge and an inner side surface which defines an outwardly flaring cavity. The side wall of the liner consists of a single crystal of metal. Since the side wall of the liner is formed of a single crystal of metal, it is free of grain boundaries. The single crystal of metal which forms the side wall is composed of metal atoms arranged in a pattern that repeats itself in three dimensions throughout the entire side wall of the liner. The fundamental building block of the crystal is the unit cell which contains an atomic arrangement within it which, when repeated in three dimensions, gives the total structure of the crystal. All unit cells within the liner have the same orientation relative to the central axis of the liner cavity. This uniformity of crystal orientation combined with the absence of grain boundaries can be used to optimize performance of the liner upon detonation of the explosive charge.

The unit cells of the single crystal liner all have the same orientation relative to the central axis of the cavity. It is contemplated that the unit cells can be oriented with [001], [110], [111] directions or with any other desired crystallographic orientation parallel to the central axis of the cavity defined by the side wall of the liner. The unit cells of the single crystal of metal forming the side wall of the liner may have a face centered cubic, body centered cubic or other construction depending on the metal selected for the liner. The cavity defined by the side wall of the liner may have any one of many known configurations. However, a generally conical configuration is preferred.

By forming the side wall of the liner as a single crystal, the liner will have a number of unique characteristics which offer potential for improved performance over the traditional polycrystalline material. As a consequence of the absence of grain boundaries, it is anticipated that the single crystal liner will experience reduced shock damage and may have a reduced rate of shock hardening compared to polycrystalline materials. Perhaps more importantly, due to the anisotropic (directional) nature of single crystals, the crystallographic orientation within the liner can be controlled to optimize deformation characteristics during explosive loading. This gives the designers of liners new degrees of freedom to tailor the behavior of the liner to meet specific requirements. Finally, a higher degree of uniformity can be achieved with single crystal liners than with polycrystalline liners.

Accordingly, it is an object of this invention to provide a new and improved liner for a shaped explosive charge and wherein the liner has a side wall which is formed of a single crystal of metal which is free of grain boundaries.

Another object of this invention is to provide a new and improved liner as set forth in the preceding object and wherein the single crystal of metal forming the liner has a selected uniform crystallographic orientation relative to the central axis of the liner.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
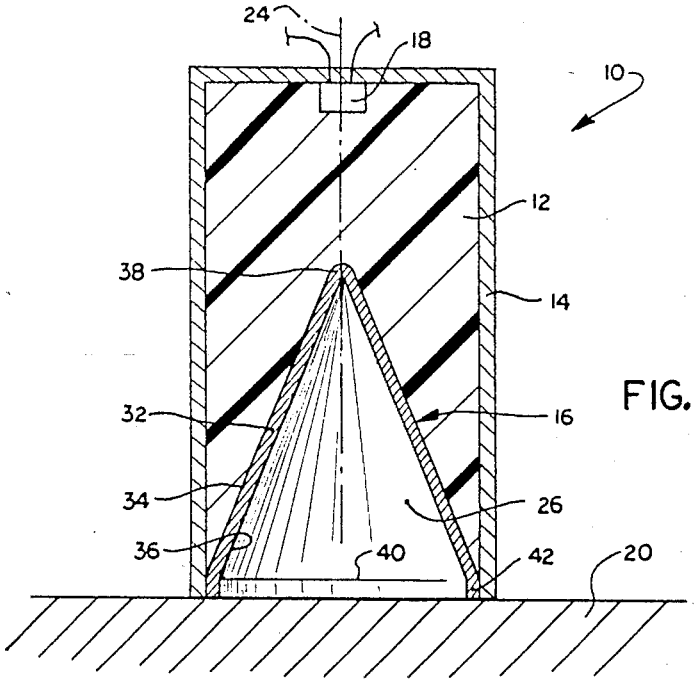
FIG. 1 is an illustration of a shaped charge having a liner constructed in accordance with the present invention.

A shaped explosive charge 10 (FIG. 1) includes a body of explosive 12 which is enclosed by an outer housing 14 and a liner 16. Upon ignition of a detonator 18, the explosive 12 is detonated. The metal liner 16 collapses and combines with gaseous and particulate explosive products to form a high density jet which impulses against and pentrates into an article 20 against which the jet is directed.

The liner 16 may collapse and deform in any one of many different ways to form the penetrating jet. High speed photographic techniques have shown that the liner can deform into a long continuous jet, which is generally preferred, or it can break up in a variety of modes to form an intermittent jet. The tail of the jet may contain a plug of liner metal which is moving slower than the forwarded portions of the jet.

In accordance with a feature of the present invention, the liner 16 is formed of a single crystal of metal. This single crystal of metal forming the liner 16 is free of grain boundaries. In order to optimize the performance characteristics of the liner 16 upon detonation of the explosive charge 12, the single crystal of metal of the liner 16 has unit cells with the same orientation relative to the central axis 24 of a cavity 26 defined by the liner 16.

In the illustrated embodiment of the invention, the cavity 26 has a conical configuration. However, it is contemplated that the cavity 26 could have other configurations, such as a hemispherical, wedge, or dish-shaped configuration if desired. Regardless of the shape of the cavity 26, the unit cells of the single crystal liner 16 all have the same orientation relative to the central axis 24 of the liner.

The liner 16 includes a generally conical side wall 32 having an outer side surface 34 which engages the explosive charge 12 and an inner side surface 36 which partially defines the cavity 26. The side wall 32 flares outwardly from a closed end 38 to an open end 40 of the cavity 26. The open end 40 of the side wall 32 has a circular cross sectional configuration as viewed in a plane extending perpendicular to the central axis 24 of the cavity.

The liner 16 often has a relatively small standoff section 42 which is connected to the outer housing 14. The axial extent of the cylindrical standoff section 42 may be varied to provide a desired distance between the explosive charge 12 and the article 20. Although the standoff section 42 is formed as part of the liner 16 in the illustrated embodiment of the invention, the standoff section 42 may be formed separately from the liner if desired. If this is done, the standoff section 42 could be formed of polycrystalline material.

Since the liner 16 is formed as a single crystal which is free of grain boundaries, it is anticipated that the liner will experience reduced shock damage and a reduced rate of shock hardening as compared to polycrystalline metals. Perhaps even more importantly, due to the anisotropic (directional) nature of single crystals, the crystallographic orientation of the unit cells within the liner 16 can be controlled to optimize deformation characteristics during loading by the explosive charge 12. This gives the designer of the shaped explosive charge 10 a new degree of freedom to tailor the liner 16 to meet the specific requirements for the shaped explosive charge 10. In addition, due to the absence of grain boundaries, a higher degree of uniformity, part-to-part, can be achieved with the single crystal liner 16 than can be achieved with materials having a polycrystalline nature.

Method of Making the Liner

Figure 2:
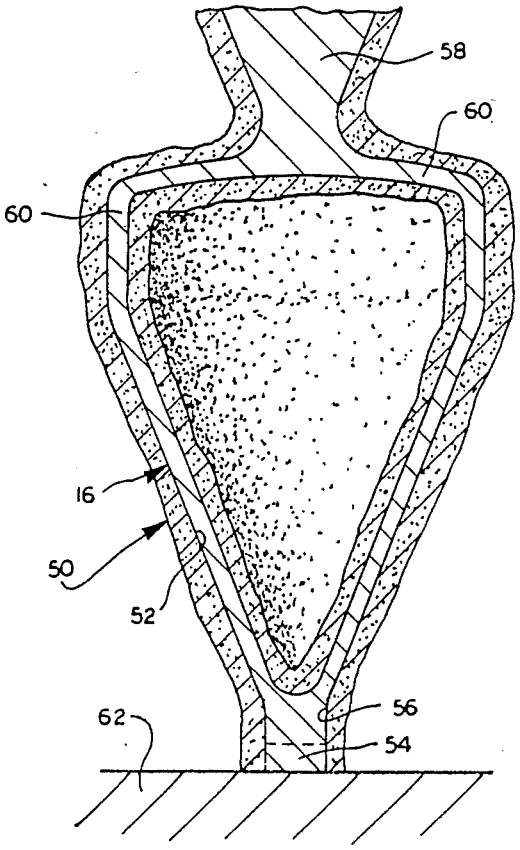
FIG. 2 is a sectional view illustrating the manner in which the liner of the shaped charge of FIG. 1 is cast as a single crystal of metal.

It is contemplated that the single crystal liner 16 could be formed by many different methods such as by directional recrystallization, zone melting, or crystal pulling from a melt. However, it is preferred to cast the single crystal liner 16. Thus, the liner 16 is cast in a ceramic mold 50 (FIG. 2). The one-piece ceramic mold 50 is formed by dipping a wax pattern in a ceramic mold material having a composition generally similar to the mold composition disclosed in U.S. Pat. No. 4,066,116. The mold 50 has an article forming section 52 in which the single crystal liner 16 is cast.

To effect the formation of the liner 16 as a single crystal, a seed crystal 54 is disposed in a starter cavity 56 in the mold 50. The seed crystal 54 is formed of the same material as the liner 16. The starter cavity 56 is connected with the article forming cavity 52. A pour cup 58 is connected with the article forming cavity 52 by runners 60.

In order to provide the single crystal liner 16 with unit cells having a desired orientation, the single crystal seed 54 has a crystallographic orientation corresponding to the desired crystallographic orientation of the liner 16. The crystallographic orientation of the seed crystal 54 can be accurately determined by Laue back reflection X-ray techniques. By carefully orienting the single crystal seed 54 in the seed cavity 56, the single crystal liner 16 can be accurately cast to have unit cells with any desired primary and second orientation.

When molten metal is poured into the pour cup 58, the molten metal flows downwardly through the runners 60 into the article mold cavity 52 to the seed cavity 56. The molten metal then engages the upper side surface of the seed or starter element 54. The lower side surface of the seed or starter element 54 is disposed on a chill plate 62 which is cooled by a flow of liquid.

Due to the rapid conduction of heat from the starter element 54 to the chill plate 62, solidification of the molten metal in the starter cavity 56 is initiated at the upper side surface of the seed or starter element 54. This metal solidifies as a single crystal having unit cells with the same orientation as the unit cells of the seed crystal. As solidification of the molten metal proceeds upwardly in the mold cavity 52, the chill plate 62 and mold 50 may be lowered to withdraw the mold from a furnace (not shown) which encloses the mold in a known manner.

The orientation of the unit cells in the single crystal liner 16 will be the same as the orientation of the unit cells in the seed crystal 54. Thus, when the molten metal solidifies against the upper side surface of the seed or starter element 54, the single crystal starter element nucleates a single crystal of metal having unit cells with the same crystallographic orientation as the unit cells of the seed or starter element 54. This crystallographic orientation is maintained as the molten metal solidifies upwardly from the starter cavity 56 throughout the article forming cavity 52 to the runners 60. Therefore, the liner 16 is cast as a single crystal of metal having unit cells with the same orientation as the orientation of the unit cells in the seed crystal 54.

It should be understood that although the liner 16 has been described as being cast as a single crystal of metal, it is contemplated that other methods of forming the liner could be used. It is also contemplated that the liner 16 could be cast as a single crystal of metal using techniques other than the known technique of providing a seed crystal 54 having a crystallographic orientation which is the same as the desired crystallographic orientation of the single crystal liner 16. For example, a suitable single crystal selector could be used in association with the chill plate 64 and mold cavity 52 to enable only a single crystal of metal to grow from the starter cavity 56 into the mold cavity 52.

One Embodiment of the Liner

In one specific preferred embodiment of the invention, the liner 16 was formed of a single crystal of high purity copper. The unit cell 64 (see FIG. 3) of copper has a face centered cubic structure. Thus, the unit cell 64 consists of an atom at each corner and an atom at the center of each face of the cube. However, the liner could be formed of iron, which has a body centered cubic structure, or other materials.

The orientation of the unit cell 64 is specified in terms of its coordinates relative to orthogonal X, Y and Z axes. When specifying directions in a unit cell 64, the notation [XYZ] is used to indicate the direction of a line from the origin to a point, the coordinates of which are X, Y and Z. By custom, brackets are utilized and fractional coordinates are avoided.

Figure 3:
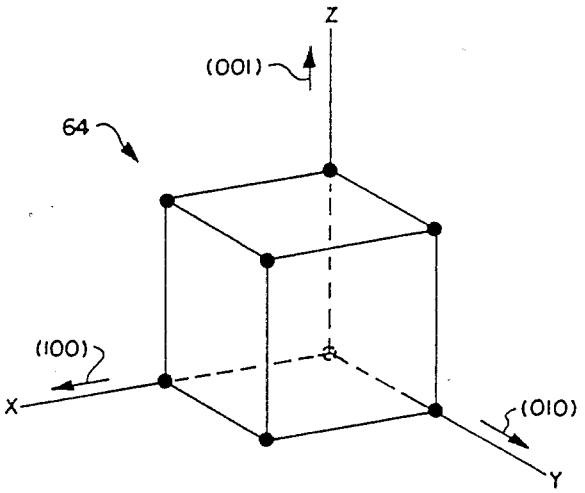
FIG. 3 is a schematic illustration depicting a cubic unit cell of an embodiment of the liner of FIG. 1 in which the [001] direction of the cubic unit cell is parallel to the central axis of the liner.

A direction along one of the edges of the cubic unit cell 64 is shown in FIG. 3 as being parallel to one of the three axes. Thus, the direction parallel to the X axis would be referred to as the [100] direction, a direction parallel to the Y axis would be referred to as the [010] direction, and a direction parallel to the Z axis would be referred to as the [001] direction.

Figure 4:
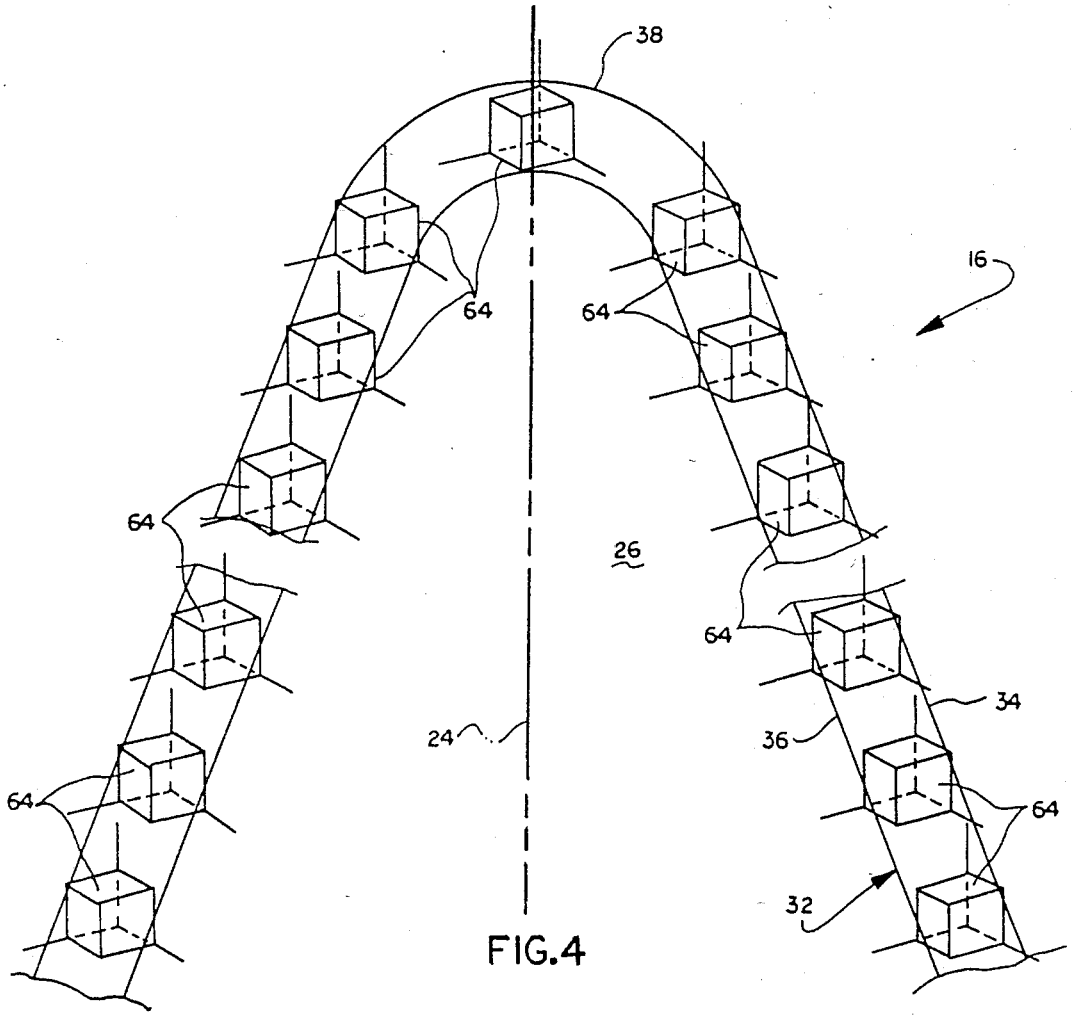
FIG. 4 is a highly schematicized illustration of a portion of the liner of FIG. 1 and illustrating the cubic unit cells with their [001] directions parallel to the central axis of the liner.

All of the cubic unit cells 64 (FIG. 3) of the single crystal liner 16 are oriented with their [001] directions parallel to the central axis 24 of the liner. The orientation of the unit cells 64 in the liner 16 are shown schematically in FIG. 4. The vertical or Z axes of the unit cells 64 are shown in FIG. 4 as being parallel to the axis 24. Of course, the liner 16 contains many more unit cells than shown in FIG. 4.

By orienting the cubic unit cells 64 with the [001] direction parallel to the central axis 24 of the liner 16, the directions of greatest ductility of the liner is transverse to the central axis of the liner. By having the ductility of the liner 16 maximized in specific selected directions with respect to the central axis 24, the performance characteristics of the liner may be enhanced for particular applications.

Other Embodiments of the Liner

In the embodiment of the liner 16 shown in FIGS. 1–4, the unit cells of the single crystal liner are oriented with the [001] direction parallel to the central axis 24 of the liner. This results in the unit cells having a relatively high ductility in a direction parallel to or perpendicular to the central axis 24 of the liner. It is contemplated that the liner 16 may be able to meet other performance requirements by having the unit cells oriented so that their direction of greatest rigidity is parallel to the central axis 24 of the liner 16. This can be done by orienting the cubic unit cells with their [111] direction parallel to the central axis 24 of the liner.

Figure 5:
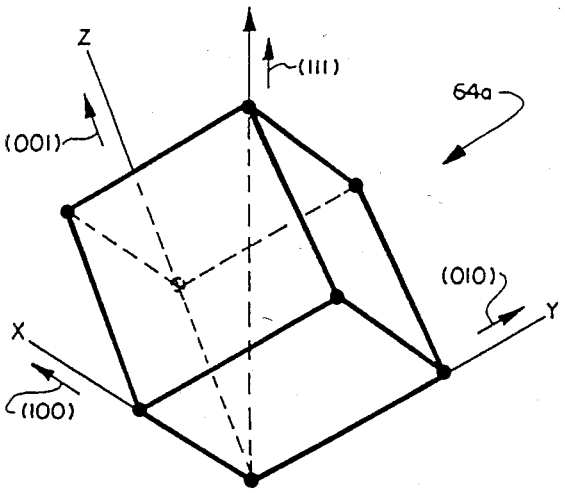
FIG. 5 is a schematic illustration of a cubic unit cell of an embodiment of the liner in which the [111] direction of the cubic unit cell is parallel to the central axis of the liner.

In FIG. 5, a cubic unit cell 64*a* is oriented with the [111] or body diagonal direction extending vertically or parallel to the central axis 24 of the liner 16. In order to cast the liner 16 with cubic unit cells 64*a* having the [111] direction parallel to the central axis 24, the single crystal seed would have unit cells oriented with their [111] directions vertical or parallel to the central axis of the starter cavity 56. This results in the growth of a single crystal of metal upwardly from the seed crystal 54 through the mold cavity 52 with the [111] direction of the unit cells parallel to a vertical axis which is coincident with the central axis 24 of the liner 16. Since the cubic unit cells of some liner materials have their highest Young's modulus or greatest rigidity in the [111] direction, this would result in the liner 16 being formed with the direction of greatest rigidity parallel to the central axis of the liner.

Although it is believed that it will be preferred to orient the cubic unit cells of the single crystal liner 16 with either the [001] direction or the [111] direction parallel to the central axis 24 of the liner, certain performance characteristics for the liner may be enhanced if the cubic unit cells are oriented with a face plane diagonal extending parallel to the central axis 24 of the liner. This would be accomplished by having the cubic unit cells oriented with their [110] direction parallel to the central axis 24. This would result in the cubic unit cells being oriented with an edge defined by the intersection of a pair of faces of the cubic unit cell being oriented upwardly and a diagonally opposite edge being oriented downwardly.

Although the liner 16 (FIG. 1) is formed of copper and has cubic unit cells 64 with either a [001], [110] or [111] direction parallel to the central axis 24 of the liner, other materials having different crystal structures could be used if desired. Thus, the liner 16 could be formed of iron which has a body centered cubic structure, or zinc which has a close packed hexagonal structure, or other pure metals and metal alloys which have a variety of crystal structures.

Summary

In view of the foregoing description, it is apparent that the present invention provides a new and improved liner 16 for use with an explosive charge 10. The liner has a side wall 32 with an outer side surface 34 which is engaged by an explosive charge 12 and an inner side surface 36 which defines an outwardly flaring cavity 26. The side wall 32 of the liner 16 is formed of a single crystal of metal. Since the side wall 32 of the liner is formed of a single crystal of metal, it is free of grain boundaries. Although the side wall 32 of the liner 16 has been described herein as having a conical configuration, the side wall could have a different configuration, such as a hemispherical, wedge or dish-shaped configuration.

The single crystal of metal which forms the side wall 32 is composed of unit cells 64. All unit cells 64 within the liner 16 have the same orientation relative to the central axis 24 of the cavity 26. This uniformity of crystal orientation combined with the absence of grain boundaries can be used to optimize performance of the liner 16 upon detonation of the explosive charge 12.

The unit cells 64 of the single crystal liner 16 all have the same orientation relative to the central axis of the cavity 26. However, it is contemplated that the unit cells could be oriented with a [001], [110], [111], or other desired directions parallel to the central axis 24 of the cavity 26 defined by the side wall 32 of the liner 16. The unit cells of the single crystal of metal forming the side wall 32 may have a face centered cubic, body centered cubic or other construction depending on the metal selected for the liner. The cavity 26 defined by the side wall 32 of the liner 16 may have any one of many known configurations other than the illustrated conical configuration. However, a generally conical configuration is preferred.

By forming the side wall 32 of the 16 liner as a single crystal, the liner will have a number of unique characteristics which offer potential for improved performance over the traditional polycrystalline material used in liners. Thus, as a consequence of the absence of grain boundaries, it is anticipated that the single crystal liner 16 will experience reduced shock damage and may have a reduced rate of shock hardening compared to polycrystalline materials. Perhaps more importantly, due to the anisotropic nature of single crystals, the crystallographic orientation within the liner 16 can be controlled to optimize deformation characteristics during explosive loading. This gives the designers of liners of the self-forging fragment or jet type new degrees of freedom to tailor the behavior of the liner to meet specific requirements. Finally, a higher degree of property uniformity, part-to-part, can be achieved with single crystal liners than polycrystalline liners.

Having described specific preferred embodiments of the invention, the following is claimed:

1. A liner for use with an explosive charge, said liner comprising a metal side wall having an outer side surface which is adapted to be engaged by an explosive charge and an inner side surface, said inner side surface of said side wall defining a cavity which flares outwardly from a closed end to an open end said open end of the cavity being adapted to be positioned adjacent to an article to be subjected to an impulse force upon detonation of the explosive charge, said side wall being formed of a single crystal of metal and being free of grain boundaries, said single crystal of metal being formed of unit cells all having the same orientation relative to the central axis of the cavity to tend to optimize performance of said liner upon detonation of the explosive charge.

2. A liner as set forth in claim 1 wherein said unit cells all have a [001] direction parallel to the central axis of the cavity.

3. A liner as set forth in claim 1 wherein said unit cells all have a [110] direction parallel to the central axis of the cavity.

4. A liner as set forth in claim 1 wherein the unit cells all have a [111] direction parallel to the central axis of the cavity.

5. A liner as set forth in claim 1 wherein the unit cells have a face centered cubic structure.

6. A liner as set forth in claim 1 wherein the unit cells have a body centered cubic structure.

7. A liner as set forth in claim 1 wherein said cavity has a generally conical configuration.

* * * * *